US006352330B1

(12) United States Patent
Lubinsky et al.

(10) Patent No.: US 6,352,330 B1
(45) Date of Patent: Mar. 5, 2002

(54) INK JET PLATE MAKER AND PROOFER APPARATUS AND METHOD

(75) Inventors: Anthony R. Lubinsky, Webster; Diane C. Freeman, Pittsford, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/516,707

(22) Filed: Mar. 1, 2000

(51) Int. Cl.[7] ..... B41J 2/205
(52) U.S. Cl. ..... 347/15; 347/43
(58) Field of Search ..... 347/12, 15, 40, 347/41, 43, 237, 240, 215, 258, 172; 358/518, 523

(56) References Cited

U.S. PATENT DOCUMENTS

| | | | | |
|---|---|---|---|---|
| 4,409,596 A | * | 10/1983 | Ishii | 347/10 |
| 4,439,789 A | | 3/1984 | Cahill | 358/466 |
| 4,543,590 A | | 9/1985 | Tazaki et al. | 347/43 |
| 4,573,788 A | | 3/1986 | Nagashima et al. | 399/44 |
| 4,580,150 A | | 4/1986 | Tazaki | 347/43 |
| 4,708,459 A | * | 11/1987 | Cowan et al. | 355/4 |
| 5,053,791 A | | 10/1991 | Baek et al. | 346/138 |
| 5,103,244 A | * | 4/1992 | Gast et al. | 347/40 |
| 5,109,460 A | | 4/1992 | Baek et al. | 385/115 |
| 5,258,777 A | | 11/1993 | DeJager et al. | 347/258 |
| 5,268,708 A | | 12/1993 | Harshbarger et al. | 346/134 |
| 5,278,578 A | | 1/1994 | Baek et al. | 347/240 |
| 5,323,179 A | | 6/1994 | Sanger et al. | 347/237 |
| 5,371,531 A | * | 12/1994 | Rezanka et al. | 347/43 |
| 5,446,477 A | | 8/1995 | Baek et al. | 346/138 |
| 5,569,573 A | | 10/1996 | Takahashi et al. | 430/138 |
| 5,714,250 A | | 2/1998 | Kato et al. | 428/328 |
| 5,750,314 A | | 5/1998 | Fromson et al. | 430/302 |
| 5,754,218 A | | 5/1998 | Baek et al. | 347/240 |
| 5,817,482 A | | 10/1998 | Bandman et al. | 435/69.1 |
| 5,836,248 A | | 11/1998 | Jarrold et al. | 101/453 |

(List continued on next page.)

FOREIGN PATENT DOCUMENTS

EP 0 776 763 A1 11/1996

*Primary Examiner*—N. Le
*Assistant Examiner*—Lamson D. Nguyen
(74) *Attorney, Agent, or Firm*—Walter S. Stevens

(57) ABSTRACT

An ink jet plate maker and proofer apparatus (66) and method adapted for printing a proof of a work to be printed, and making a printing plate (16) for printing the work, including a first element (68) including circuitry (70) controllably operable for generating ink drops of a first predetermined volume for printing the proof on a proofing receiver, and a second element (86) including circuitry (88) controllably operable for generating liquid drops of a second predetermined volume for image wise making or completing the printing plate (16), the second predetermined volume being different from the first predetermined volume. According to an exemplary embodiment, the apparatus includes a first print head (82) connected in fluid communication with a source of ink (106) for printing the proof of the work, and a second print head (92) in fluid communication with a source of a liquid (108) for making the printing plate, the print heads (82, 92) being disposed for ejecting drops of the ink and the liquid for making the printing plate onto a proofing receiver and a treated plate, respectively, positionable on a platen (96) relatively moveable with respect to the print heads (82, 92). The first element (68) is connected in electrical communication with the first print head (82) and includes a first clock (72) connected to a signal generator (76) operable for producing a drive signal for generating the ink drops of the first predetermined volume for printing the proof on the proofing receiver. The second element (86) includes a second clock (90) connected to the signal generator (76) and operable in conjunction therewith for driving the second print head (92) for generating the liquid drops for making the printing plate (16).

22 Claims, 7 Drawing Sheets

U.S. PATENT DOCUMENTS 5,836,249 A 11/1998 Chatterjee et al. ..... 101/467
5,839,369 A 11/1998 Chatterjee et al. ..... 101/467
5,839,370 A 11/1998 Chatterjee et al. ..... 101/467
5,855,173 A 1/1999 Chatterjee et al. ..... 101/453
5,893,328 A 4/1999 Ghosh et al. ..... 101/467
5,900,891 A * 5/1999 Shimoda ..... 347/43
5,919,600 A 7/1999 Huang et al. ..... 430/270.1
5,925,496 A 7/1999 Ghosh et al. ..... 430/49
5,927,207 A 7/1999 Ghosh et al. ..... 101/455
5,939,228 A 8/1999 Tashiro et al. ..... 430/49
6,019,045 A 1/2000 Kato et al. ..... 101/466
6,140,391 A * 10/2000 Zou et al. ..... 523/160
6,164,757 A 12/2000 Wen et al. ..... 347/43
6,204,873 B1 * 3/2001 Shimazaki ..... 347/172

* cited by examiner

INK JET PLATE MAKER AND PROOFER APPARATUS AND METHOD

FIELD OF THE INVENTION

The present invention relates to an ink jet printer apparatus and method, and more particularly, to an ink jet printer and method for making a printing plate and a proof of a work such as text and/or an image to be printed by the printing plate.

BACKGROUND OF THE INVENTION

When printing, a printing plate for a work is typically made, and then one or more proofs of the work are printed using the printing plate to allow determining desirability and accuracy of the printed image before a large number of prints are printed. The proofing activity might take several stages: an initial, creative stage in which a computer display might be adequate for proofing; an intermediate stage in which a desktop-type inkjet or thermal printer output might be used; and a final, more critical stage in which an accurate picture of the final plate result, including the micro-structure of the halftone dots to be produced on the plate, is desired. It is toward this last need for an accurate halftone proofer, matched to a corresponding platemaker, that the present invention is directed.

It is known to use an ink jet printer to make printing plates. Reference in this regard, Fromson et al. U.S. Pat. No. 5,750,314 issued May 12, 1998 which discloses a method for selectively imaging a lithographic printing plate using an ink jet printer. In the Fromson et al. method, a substrate is coated with a first material, which is soluble in a first solvent, whereupon a second material, which strongly adheres to the first material and insoluble in the first solvent, is selectively applied by an ink jet printer. The substrate is then developed in the first solvent to establish the image. However, Fromson et al. does not disclose a method or apparatus for producing a proof of a work to be printed, without first requiring making the printing plate.

Therefore, what is required is a method and apparatus for printing a proof of a work to be printed using a printing plate, which does not require first making the printing plate. What are also required are an inkjet printer apparatus and method for making both an accurate proof of a work to be printed and a printing plate for the work.

SUMMARY OF THE INVENTION

An object of the present invention is to provide an ink jet printer and method for printing an accurate proof of a work to be printed using a printing plate without first requiring making the printing plate, and for making the printing plate.

With this object in view, the present invention resides in an ink jet printer adapted for printing a proof of a work to be printed and making or completing a printing plate image wise for printing the work, the printer including a first element including circuitry controllably operable for generating ink drops of a first predetermined volume for printing the proof on a proofing receiver, and a second element including circuitry controllably operable for generating liquid drops of a second predetermined volume for making or completing the printing plate image wise, the second predetermined volume being different from the first predetermined volume.

According to an exemplary embodiment of the present invention, the ink jet printer includes a first print head connected in fluid communication with a source of ink for printing the proof of the work, and a second print head in fluid communication with a source of a liquid for making the printing plate, the print heads being disposed for ejecting drops of the ink and the liquid image wise onto a proofing receiver and a treated plate, respectively, positionable on a platen relatively moveable with respect to the print heads. The first element is connected in electrical communication with the first print head and includes a first clock connected to a signal generator operable for producing a drive signal for driving the print head for generating the ink drops of the first predetermined volume for printing the proof on the proofing receiver. The second element includes a second clock connected to the signal generator and operable in conjunction therewith for driving the second print head for generating the liquid drops for printing the image on the treated plate for making or completing the printing plate. A machine control is connected to the signal generator and is operable for selecting the first print head and the first clock for ejecting the ink drops image wise onto the proofing receiver, which can be a sheet of proofing paper or the like, for creating the proof, or the second print head and the second clock for ejecting the liquid image wise onto the treated plate for making or completing the printing plate.

The treated plate for instance can be a grained, anodized aluminum or polyester plate having a hydrophilic surface and having a known surface treatment to control spreading of ink drops thereon. The liquid deposited on the treated surface for instance can include an oleophilic liquid containing a polymer such as pyridine-containing polymer. Such liquids are preferred as they have a known ability to pick up and deliver printing inks to a blanket roller of a printing press. Such liquids are also known for the durability of the dried spots that are formed.

A feature of the present invention is the provision of an ink jet printer adapted for making or image wise completing a printing plate, and a proof of a work to be printed using the printing plate without first requiring making the printing plate.

Another feature of the invention is the provision of an ink jet printer operable to produce drops having different characteristics for printing corresponding images of a work on different printing receivers.

As an advantage of the present invention, a printing plate and a proof of a work to be printed using the printing plate can be produced using the same apparatus.

As another advantage, an accurate proof of a work to be printed using a printing plate can be produced, thus avoiding cost and time lost producing an undesirable or incorrect printing plate.

According to the invention, the volume characteristics of drops of ink or other liquid produced by an ink jet printer can be varied by altering aspects of the drive signal used for producing the drops, including, but not limited to, the voltage, frequency, and/or wave form of the drive signal.

These and other objects, features an advantages of the present invention will become apparent to those skilled in the art upon a reading of the following detailed description when taken in conjunction with the drawings wherein there are shown and described illustrative embodiments of the invention.

BRIEF DESCRIPTIONS OF THE DRAWINGS

While the specification concludes with the claims particularly pointing out and distinctly claiming the subject matter of the present invention, it is believed the invention will be better understood from the following detailed description when taken in conjunction with accompanying drawings wherein:

FIG. 1 a simplified schematic view of an ink jet print head showing ejection of a liquid drop therefrom onto a treated plate;

Figure 6A:
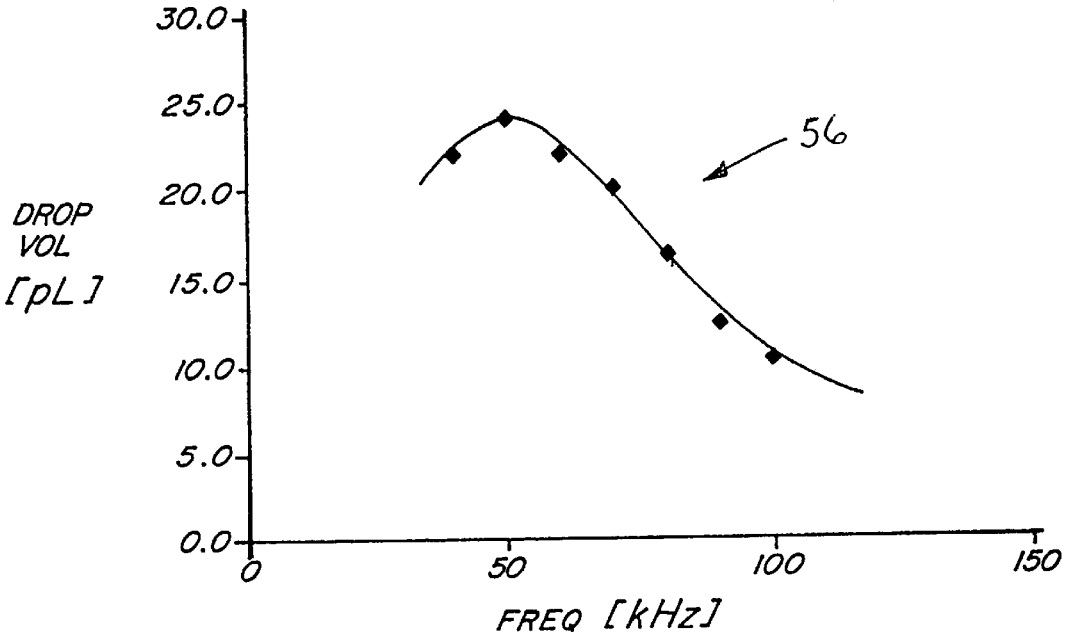
Figure 6B:
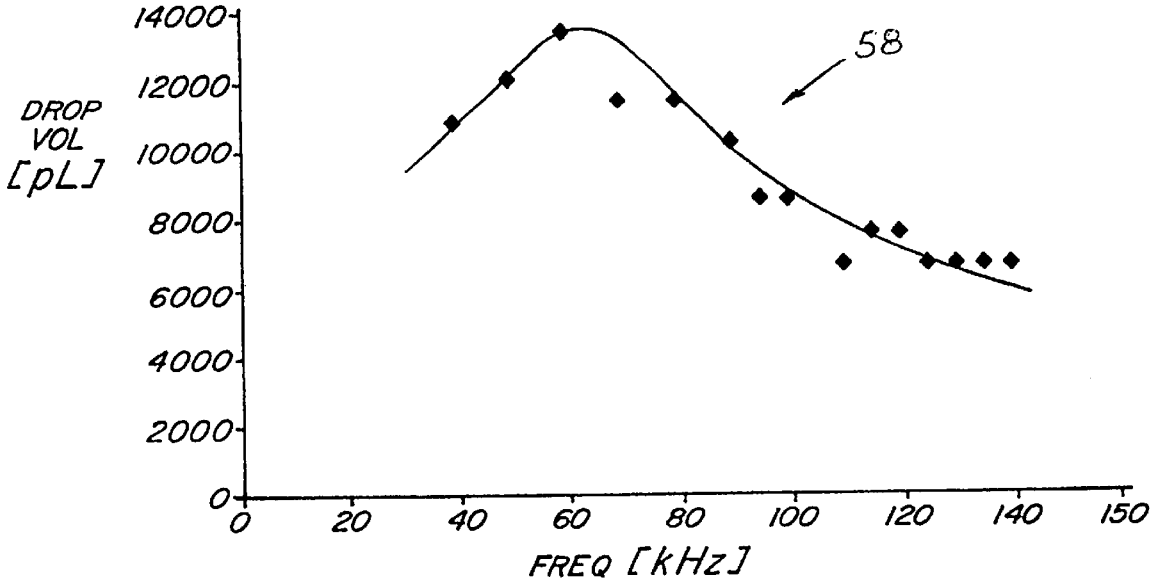
Figure 7A:
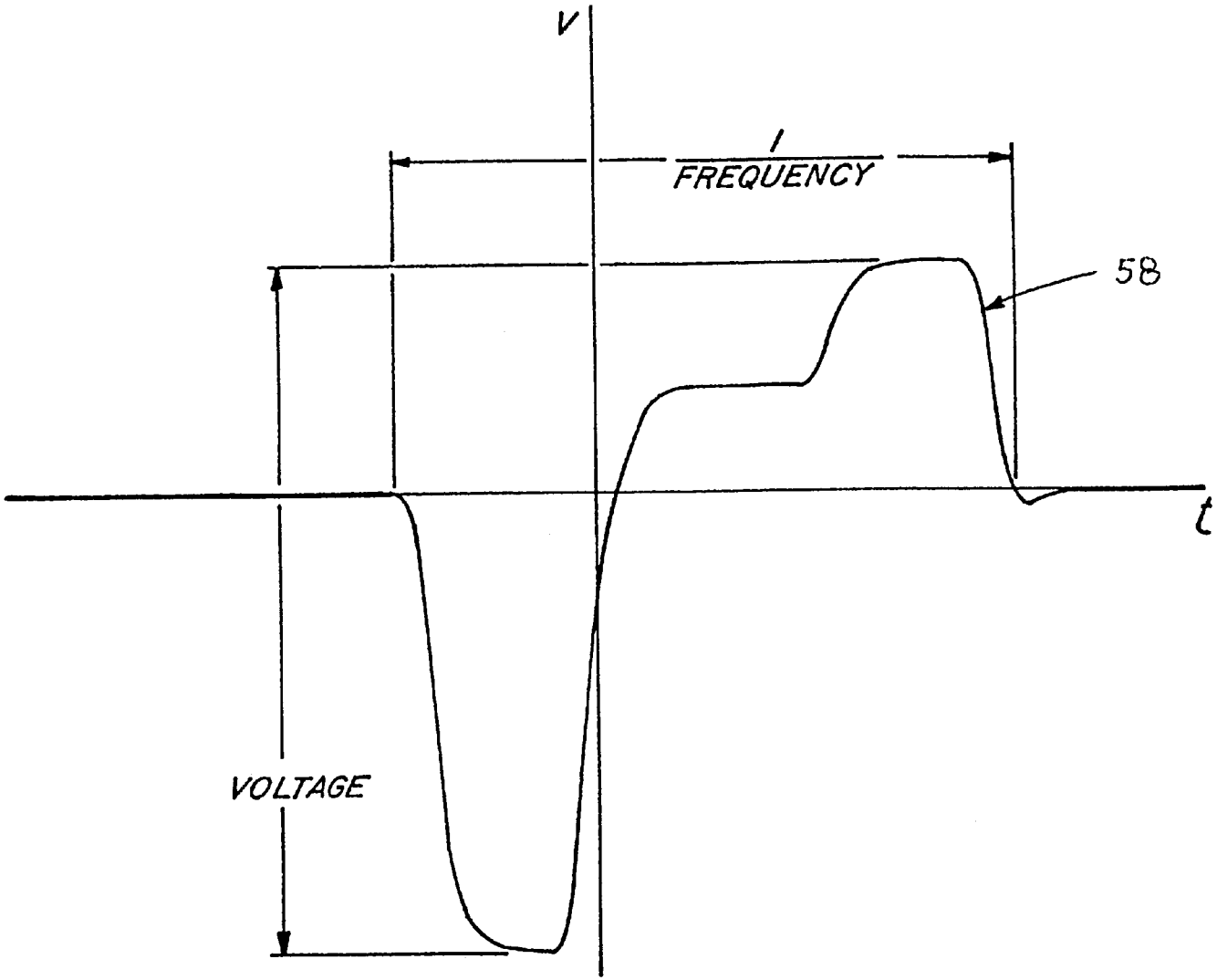
Figure 7B:
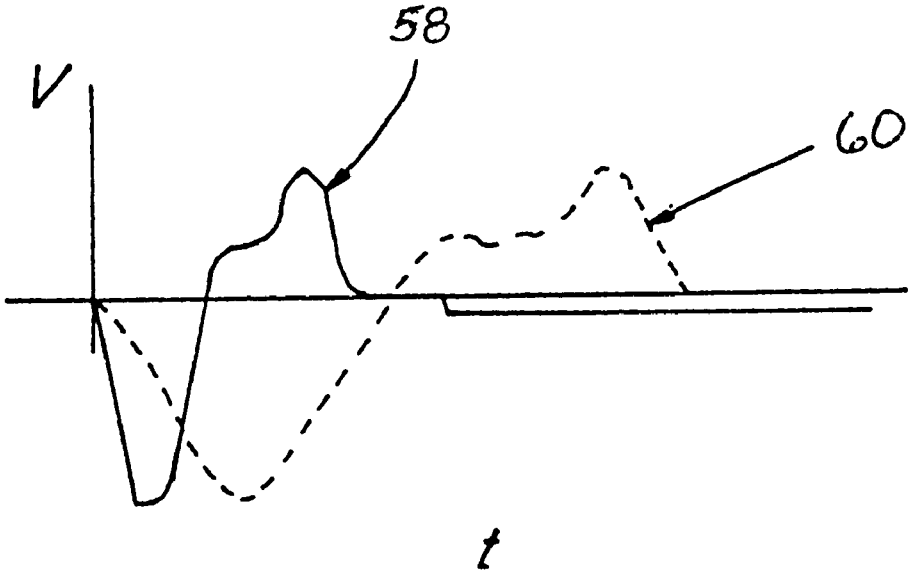
Figure 7C:
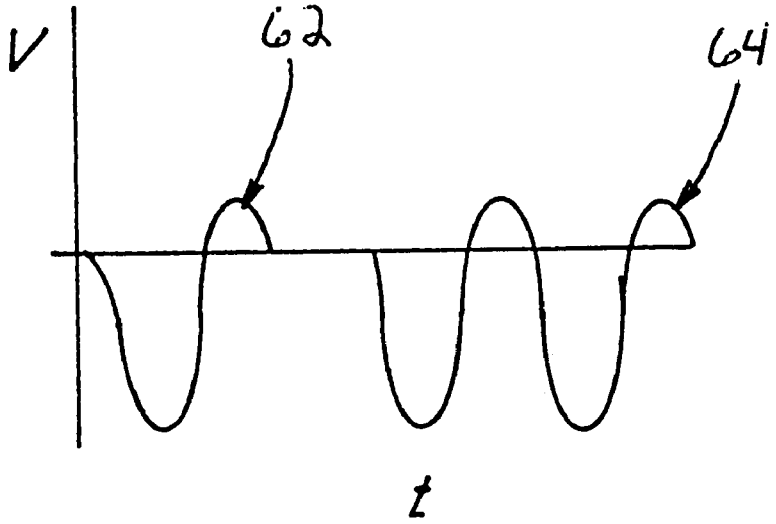
Figure 8:
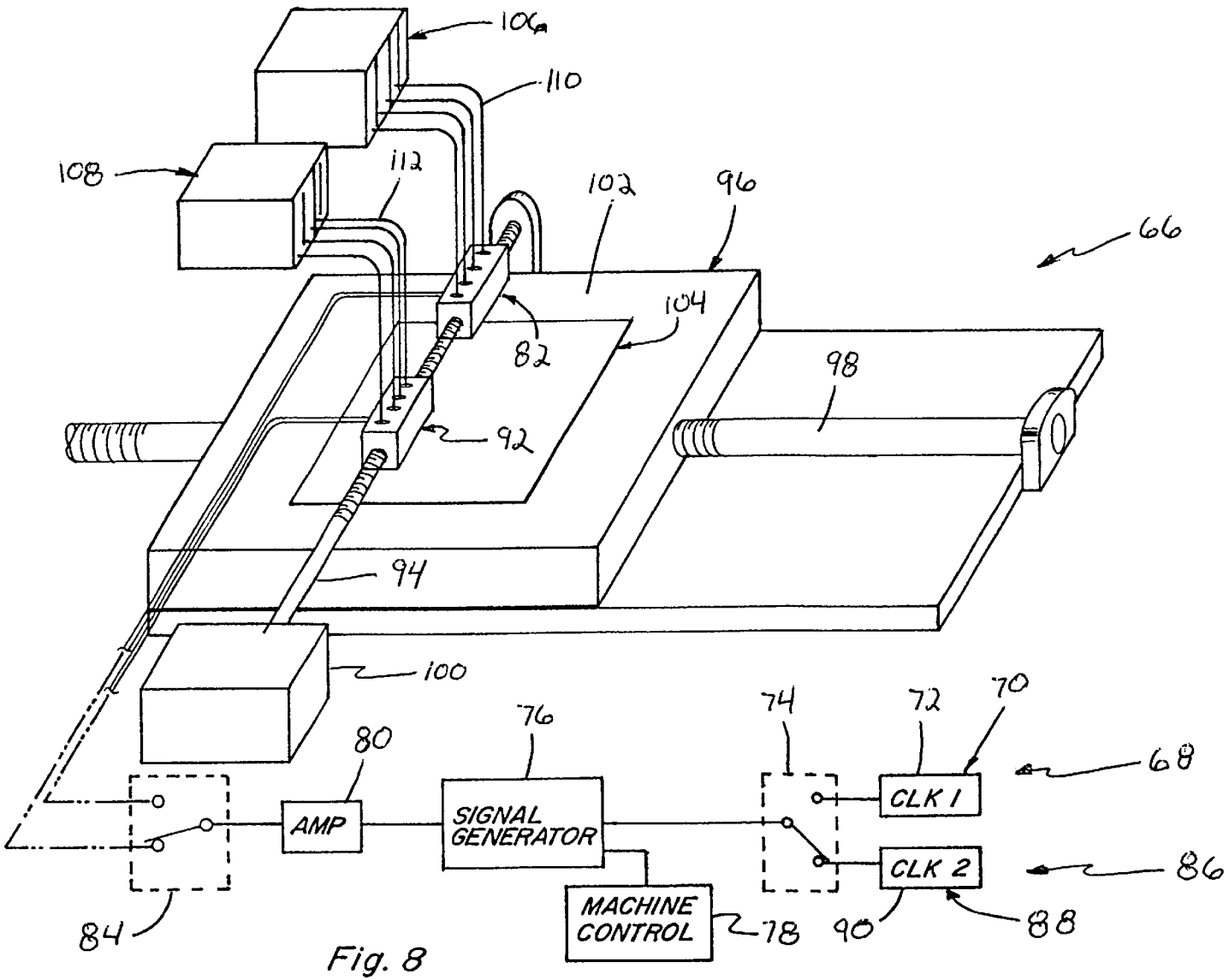

FIG. 6*a* is a graphical representation of a drop volume versus drive signal frequency, generally;

FIG. 6*b* is another graphical representation of drop volume versus drive signal frequency for a representative piezoelectric ink jet print head;

FIG. 7*a* is a graphical representation of a drive signal wave form according to the present invention;

FIG. 7*b* is a graphical representation of the drive signal wave form of FIG. 7*a* and a second drive signal wave form according to the invention;

FIG. 7*c* is a graphical representation of other drive signal wave forms according to the invention; and FIG. 8 schematic representation of an ink jet printer according to the invention.

DETAILED DESCRIPTION OF THE INVENTION

The present description will be directed in particular to elements forming part of, or cooperating more directly with, an apparatus and method in accordance with the present invention. It is to be understood that elements not specifically shown or described may take various forms well known to those skilled in the art.

Figure 1:
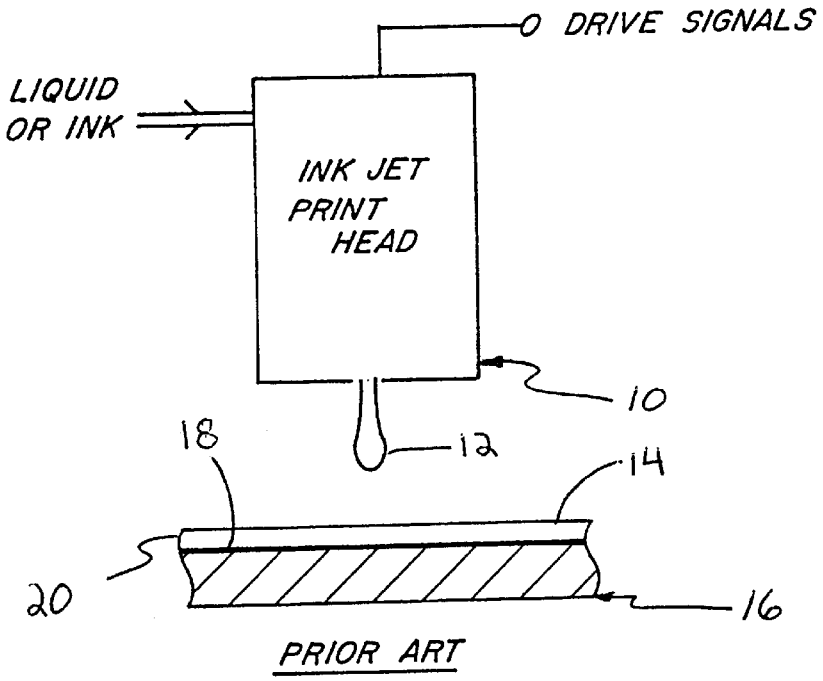

Therefore, referring to FIG. 1, an ink jet print head 10 is shown ejecting a liquid drop 12 onto a surface 14 of a treated plate 16 in an image wise manner for making or completing a printing plate. Plate 16 includes a substrate 18 of a conventional material such as aluminum or polyester, and a layer 20 of a known surface treatment to control spreading of ink and other liquids deposited on surface 14. Layer 20 can include, but is not limited to, surfactants with hydrophilic heads and hydrophobic tails, and other well known substances. Liquid drops, represented by drop 12, are delivered to surface 14 in an image wise manner and comprise a liquid, such as a liquid containing a polymer such as, but not limited to, a pyridine-containing polymer, which has an observed ability after drying to pick up and deliver printing inks to a blanket roller of a printing press, and excellent durability even after much use.

As another alternative, layer 20 can include for instance any of the substances identified as the first material for picking up ink, or a primer, as disclosed in Fromson et al. U.S. Pat. No. 5,750,314, discussed hereinabove and incorporated herein by reference, drops 12 being suitably composed of a compatible adhesive or other of the second materials disclosed in the Fromson et al. patent.

According to the present invention, print head 10, or another print head, can be used to deliver ink drops to a surface of a proofing receiver (not shown) in a similar image wise manner to produce a proof of a work to be printed using plate 16, the delivered ink drops and liquid drops being of different predetermined volumes so as to form corresponding printed dots on the plate or proofing receiver such that the image of the proof is accurately representative of or replicates the image to be printed using the plate, the different drop volumes being controlled by drive signals received from drive circuitry for the print head or print heads.

Figure 2:
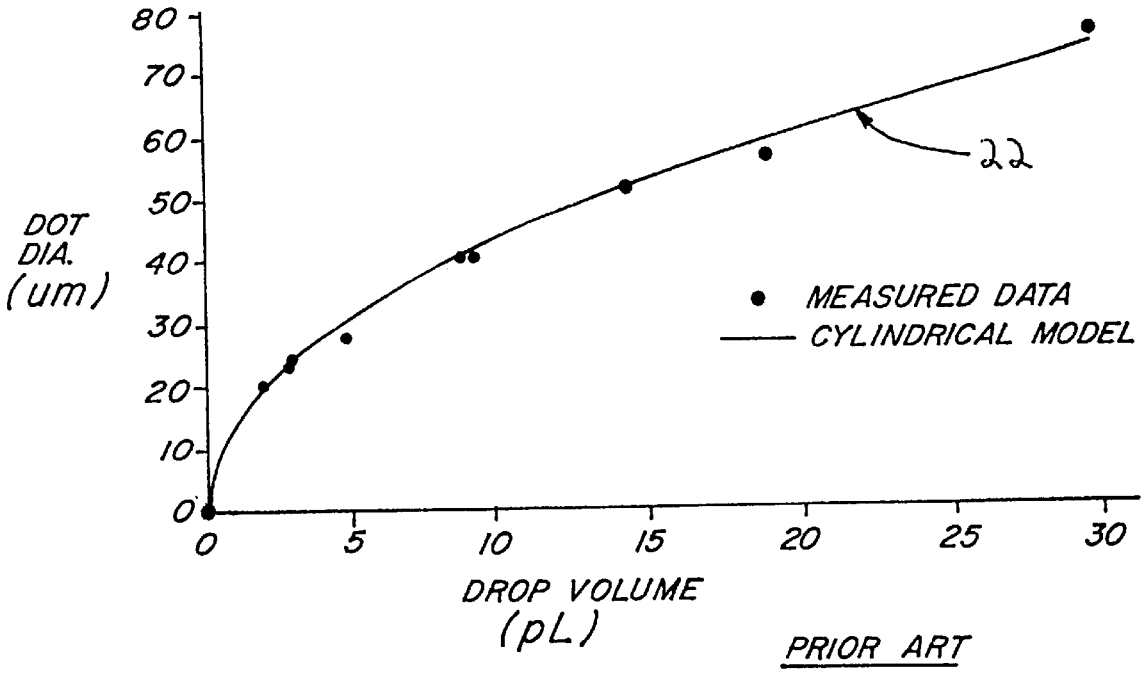
FIG. 2 is a graphical presentation of dot diameter versus drop volume for printing receivers generally.

Referring to FIG. 2, a curve 22 is shown illustrating a known relationship of dot diameter in micrometers (um) to drop volume in picoliters (pL) for typical printed dots, it being observed that dot size increases as drop volume increases.

Figure 3:
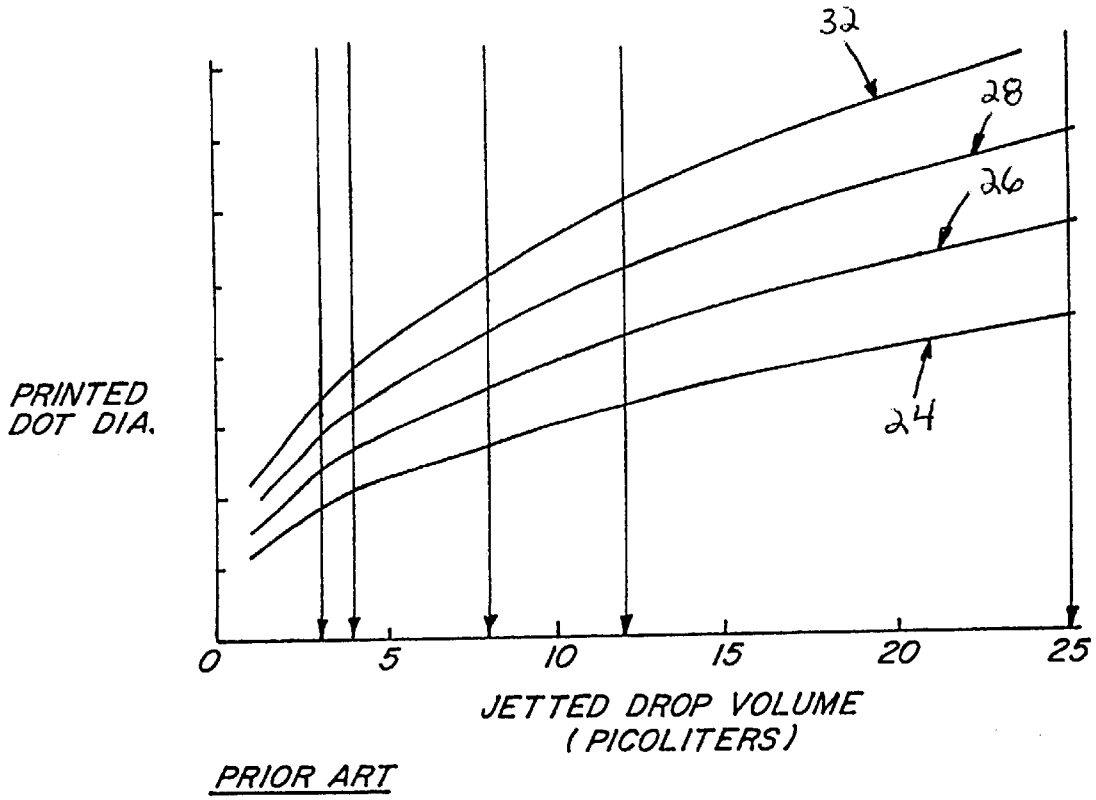
FIG. 3 is another graphical representation of dot diameter versus drop volume for a variety of different receiving surfaces.

Referring to FIG. 3, curves 24, 26, 28, and 32 illustrate the relationship of dot diameter to jetted drop volume for dots of various liquids delivered by a typical ink jet printer onto plates having layers of a variety of different treatments thereon, namely, curve 32 representing no treatment and curves 24, 26, 28 representing varying types of chemical treatments, respectively.

Figure 4:
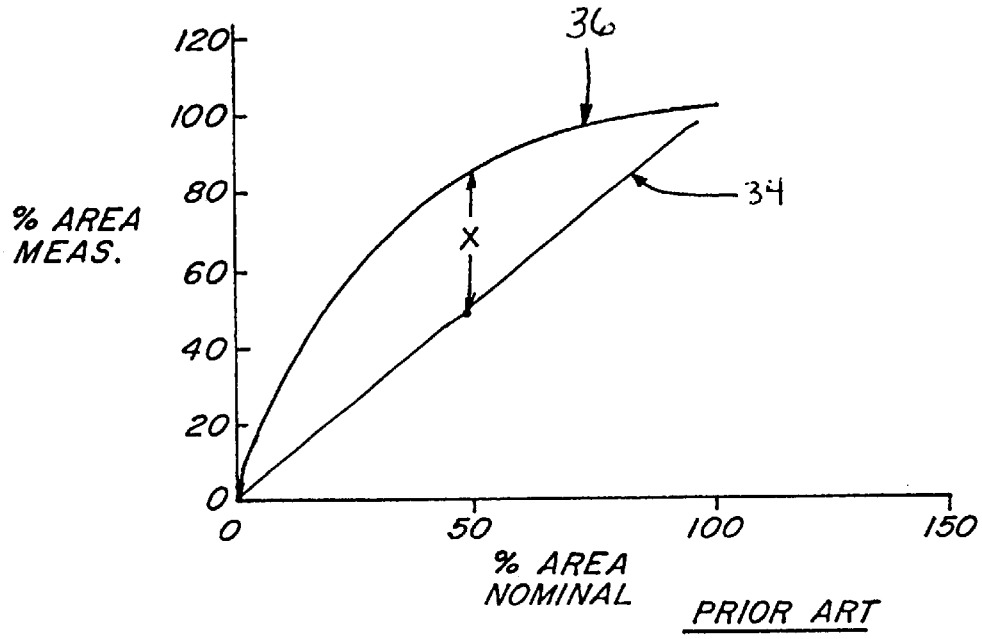
FIG. 4 is a graphical representation of percent measured dot area versus nominal percent dot area for a conventional printing plate, illustrating dot gain.

In FIG. 4, a curve 34 represents measured percent area coverage as a function of nominal percent area coverage for typical dots on a conventional printing plate, and a curve 36 represents measured percent area coverage as a function of nominal percent area coverage for dots printed on a printing receiver such as press paper using the printing plate, the vertical distance, represented as X, between curves 34 and 36 at any given point representing dot gain, that is, the difference between the percent of area covered by the dot formed on the printing plate, and the percent of area of the dot printed on the paper by the dot on the printing plate. Typically, it has been found that the percent area coverage on the print is 15–18 percent larger than the percent area coverage on the plate, and the printed dot will be 7–10 percent larger than the dot on the plate.

Figure 5:
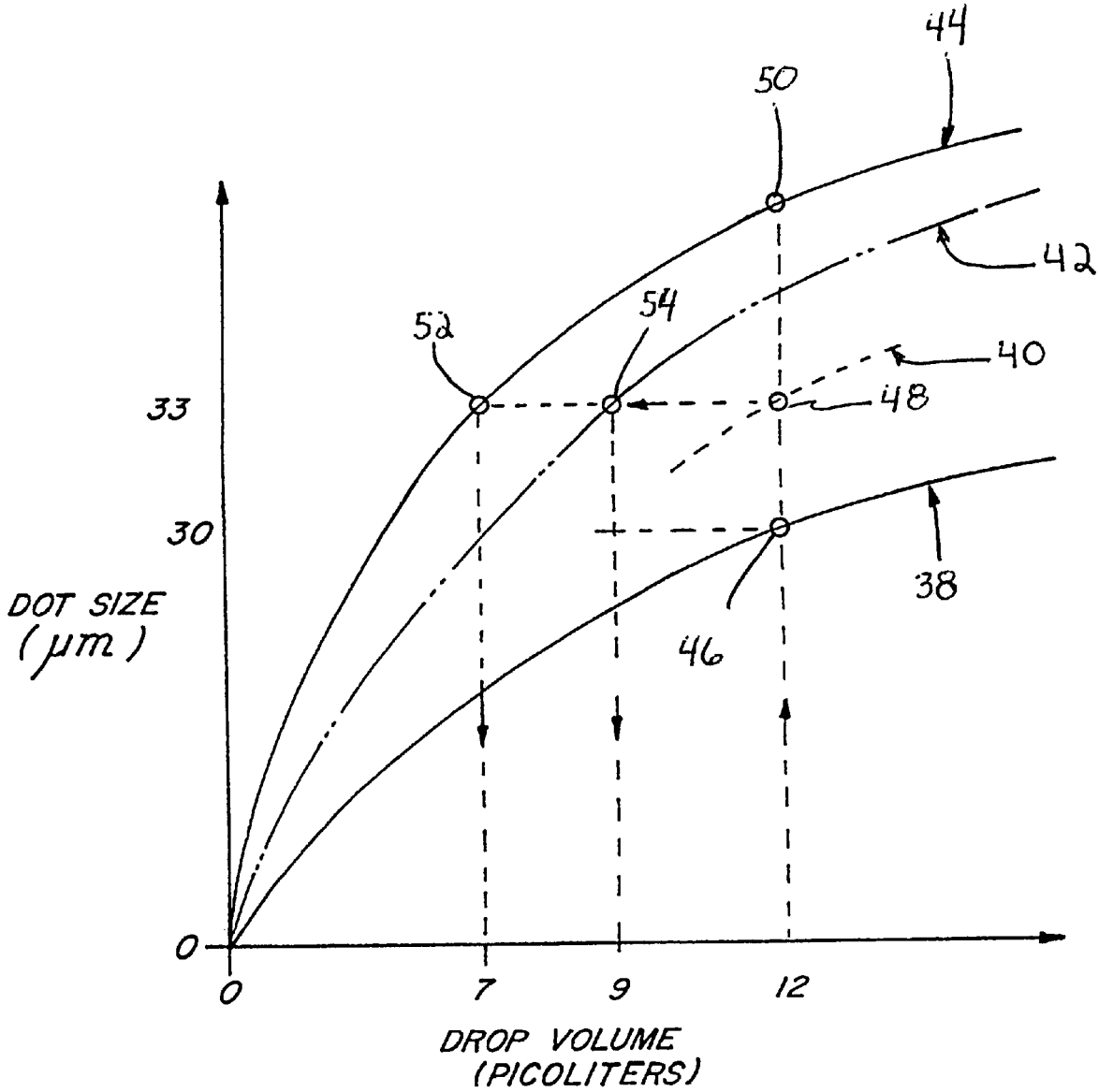
FIG. 5 is a graphical representation of dot size versus drop volume for several printing receivers and a selected treated plate.

To illustrate the effect of this difference in dot sizes, reference is made to FIG. 5 wherein curve 38 represents dot size as a function of drop volume for dots formed on a treated plate such as plate 16 in the manner described above with reference to FIG. 1. Curve 40 represents dot size as a function of drop volume for ink dots printed on paper by the dots of curve 38, the vertical distance between curves 38 and 40 corresponding to the dot gain. Curve 42 represents dot size as a function of drop volume for dots printed by an ink jet printer on a treated paper, and curve 44 represents dot size as a function of drop volume for dots printed by an ink jet printer on a conventional proofing paper.

As an example, if it were decided to make a printing plate having a dot size of 30 um, as shown at point 46, using curve 38, the required drop volume of the liquid used for producing the dots on the printing plate in the manner described in reference to FIG. 1 would be 12 pL. The resulting size of dots printed by the dots on the treated plate would then be 33 um, as shown at point 48 on curve 40, due to the dot gain. If the ink jet printer were used to print ink dots on the proofing paper of curve 44 using the same drop volume, the resultant dots would have a size substantially greater than 33 um, as shown at point 50. However, if the drop volume were reduced to 7 pL, the resultant dots printed on the proofing paper would be the desired 33 um size, as shown at point 52, such that a proof printed with the 7 pL drops will be accurately representative of a print printed by the dots on the treated plate made using the 12 pL drops. Similarly, a proof printed on treated paper using 9 pL drops would have the desired 33 um size dots, as shown at point 54 on curve 42. This demonstrates that characteristics or parameters of the paper used for proofing can be varied to facilitate matching dot size with a print made using a printing plate, for instance by minimizing the difference between the liquid drop volume required for making the printing plate and the ink drop volume required for making the matching proof.

It has been found that some ink jet printheads can be made to produce drops of different volumes by varying parameters of the drive signals used for producing the drops. For instance, for some printers it has been found generally that drop volume can be varied as a function of signal frequency, a plot 56 of drop volume verses drive signal frequency, generally, being shown in FIG. 6*a*, illustrating a decrease in drop volume as drive signal frequency increases. Referring to FIG. 6*b*, a plot 58 of drop volume verses drive signal frequency for a typical shear-mode piezoelectric ink jet print head is shown, again, drop volume generally decreasing as the drive signal frequency increases.

Turning to FIG. 7*a*, a trace 58 of a drive signal wave form for a shearmode piezoelectric ink jet print head is shown, the vertical axis representing voltage and the horizontal axis representing time, the wave form frequency and voltage amplitude of the trace being denoted. FIG. 7*b* shows trace 58 and a second drive signal wave form trace 60, trace 58 being representative of a drive signal having a frequency of about 120 kHz, and trace 60 being representative of a 60 kHz drive signal of the same amplitude, for driving a shear-mode piezoelectric ink jet printer for producing a 7 pL drop and a 12 pL drop, respectively. Referring back to the discussion with reference to FIG. 5, a 12 pL drop of a liquid for forming a printing plate will result in a 33 um printed dot on the press, and a 7 pL drop of ink will form a 33 um printed dot on a piece of proofing paper.

Referring to FIG. 7*c*, alternative drive signal traces 62 and 64 for a shear-mode piezoelectric ink jet printer are shown, both traces 62 and 64 having a generally sinusoidal wave form shape, trace 62 having a single drive pulse and trace 64 having a two drive pulses, for producing smaller and larger drops, respectively.

Referring to FIG. 8, an ink jet proof making and printing plate making apparatus constructed and operable according to the above-discussed teachings of the present invention is shown. Apparatus 66 includes a first element 68 including circuitry 70 controllably operable for generating ink drops of a first predetermined volume for printing the proof on a proofing receiver. Circuitry 70 includes a first clock 72 selectably connectable by a switch 74 in electrical communication with a signal generator 76 for driving signal generator 76 at a first frequency. Signal generator 76 is connected in electrical communication with a machine control 78 and an amplifier 80, which, in turn, is selectably connectable in electrical communication with a first ink jet print head 82 by a switch 84. Apparatus 66 includes a second element 86 including circuitry 88 controllably operable for generating liquid drops of a second predetermined volume for making the printing plate, the second predetermined volume being different from the first predetermined volume. Circuitry 88 includes a second clock 90 selectably connectable by switch 74 in electrical communication with signal generator 76 for driving signal generator 76 at a second frequency, signal generator 76 again being connected to machine control 78 and to amplifier 80, which, in turn, is selectably connectable to a second ink jet print head 92 by switch 84. Switches 74 and 84 can be jointly switchable, for instance by machine control 78, as desired, to allow selecting the first or second frequency and associated print head 82, 92.

Print heads 82 and 92 are threadedly mounted for longitudinal movement on a rotatable cross screw 94 in spaced, opposed relation to a platen 96. Platen 96, in turn is threadedly mounted for longitudinal movement on a lead screw 98 oriented at a right angle to cross screw 94. Cross screw 94 is rotatable by a drive motor 100, and lead screw 98 is rotatable by a similar drive motor (not shown) while print heads 82, 92 are prevented from rotating, for relatively moving print heads 82, 92 and platen 96 longitudinally along the screws in the well known conventional manner for positioning the print heads 82, 92 in desired relation to a top surface 102 of the platen. Top surface 102 is conventionally adapted for receiving a printing plate such as treated plate 16 and/or a proofing receiver, such as a piece of paper, as represented by element 104, and holding the plate or receiver using vacuum or the like, for receiving ink or liquid drops in an image wise manner during the relative movement. Print head 82 is connected in fluid communication with an ink source 106 such as a tank or reservoir containing inks, which may include one to six or more different ink colors, and print head 92 is connected in fluid communication with a source of liquid 108 for making a printing plate such as plate 16, by flexible lines 110 and 112, respectively, to provide ink or liquid delivery to the print heads 82, 92 during the relative movement.

Signal generator 76 is adaptable for generating drive signals having any of the wave form shapes shown in FIGS. 7*a*, 7*b* and 7*c*, at a frequency determined by the clock 72 or 90 selectably connectable thereto. For example, for printing proofs on a printing receiver, the frequency of first clock 72 can be set to produce the above discussed 120 kHz for driving print head 82 for producing ink drops having a volume of 7 pL, and the frequency for second clock 90 can be set to produce the above discussed 60 kHz for driving print head 92 for producing 12 pL liquid drops for making the printing plate. Again referring to FIG. 5, a resultant proof printed using ink drops of 7 pL volume will have image wise dots of a 33 um size, and prints printed by the printing plate made using 12 pL liquid drops will also have 33 um dots, such that the proof will accurately reproduce or replicate the image to be printed using the printing plate.

It may be appreciated from the description hereinabove, that according to the present invention, a proof accurately representative of or replicating a work to be printed using a printing plate can be produced by an ink jet printer. As taught above, this is achieved by utilizing a drive signal for the ink jet printer operable for emitting ink drops of a volume for producing printed dots on a selected proofing receiver of a size equal or substantially equal to the dot size of the work when printed using the printing plate. The required drop volume can be achieved by adjusting the frequency of the drive signal, the wave form thereof, the amplitude thereof, or any other characteristic which suitably effects drop volume.

It may also be appreciated that the ink jet printer can utilize a wide variety of conventional print head constructions, including, but not limited to, a shear-mode piezoelectric print head. The printer platen may be flat, or it may be in the form of a moving cylinder. The print head drive waveforms may be varied by changing the signal generator frequency, or by retrieving any one of a number of digital waveforms, stored in memory. The printer may also include a single print head for making the printing plate and printing the proof, or different print heads for those functions. The treated plate, for instance, can be an aluminum or polyester plate having a surface treatment to control spreading of ink drops thereon. The liquid deposited on the treated surface, for instance, can include but is not limited to a liquid containing a polymer such as pyridine-containing polymers.

It may be further appreciated that as an advantage of the present invention, a printing plate and a proof of a work to be printed using the printing plate can be produced using the same apparatus.

As another advantage, an accurate proof of a work to be printing using a printing plate can be produced, thus avoiding cost and time lost producing an undesirable or incorrect printing plate.

While the invention has been described with particular reference to its preferred embodiment, it will be understood by those skilled in the art that various changes may be made and equivalents may be substituted for elements of the preferred embodiment without departing from the invention. In addition, many modifications may be made to adapt a particular situation and material to a teaching of the present invention without departing from the essential teachings of the invention.

Therefore, what is provided is an ink jet printer and method for printing an accurate proof of a work to be printed using a printing plate without first requiring making the printing plate, and for making the printing plate.

Parts List

10 ink jet print head
12 fluid droplet
14 surface
16 treated plate
18 substrate
20 layer
22 graph
24 curve
26 curve
28 curve
32 curve
34 curve
36 curve
38 curve
40 curve
42 curve
44 curve
46 point
48 point
50 point
52 point
54 point
56 representative plot
58 representative plot
60 trace
62 trace
64 trace
66 apparatus
68 first element
70 circuitry
72 first clock
74 switch
76 signal generator
78 machine control
80 amplifier
82 first ink jet print head
84 switch
86 second element
88 circuitry
90 second clock
92 second ink jet print head
94 cross screw
96 platen
98 lead screw
100 drive motor
102 top surface
104 representative element
106 ink source
108 source of liquid
110 line
112 line

What is claimed is:

1. An ink jet printer for printing a proof of a work to be printed and making a printing plate for printing the work comprising;

a first element including circuitry controllably operable for generating ink drops of a first predetermined volume for printing the proof on a proofing receiver, the proof having micro-structures of dots that for halftone dots; and a second element including circuitry controllably operable for generating liquid drops of a second predetermined volume for making the printing plate, the second predetermined volume being different from the first predetermined volume, wherein micro-structure of dots that form halftone dots on the plate are matched to that on the proof so that a print from the plate can be printed that has halftone dot micro-structures that are substantially identical to that of the proof.

2. The ink jet printer of claim 1, wherein the first and second elements each comprise a piezoelectric print head.

3. The ink jet printer of claim 2, further comprising a platen adapted for holding the printing plate and the proofing receiver and apparatus for relatively moving the platen and the piezoelectric print heads.

4. The ink jet printer of claim 2, wherein the circuitry of the first element includes a first clock operable at a first speed, the circuitry of the second element includes a second clock operable at a second speed different from the first speed, and the printer includes a signal generator connectable in driven relation to the first and second clocks, respectively, and in driving relation to the print heads, respectively.

5. The ink jet printer of claim 1, wherein the circuitry includes a signal generator operable for controlling the volume of the generated drops by controlling a voltage parameter of a drive signal generated thereby.

6. The ink jet printer of claim 1, wherein the circuitry includes a signal generator operable for controlling the volume of the generated drops by controlling a wave form parameter of a drive signal generated thereby.

7. A method for printing a proof of a work to be printed and making a printing plate for the work, comprising the steps of:

a. providing an ink jet printer including circuitry and a print head controllably operable for generating ink drops of a first predetermined volume for printing the proof of the work on a proofing receiver, and circuitry and a print head controllably operable for generating drops of a second predetermined volume of a liquid for making the printing plate, the second predetermined volume being different from the first predetermined volume;

b. controllably operating the first named circuitry and print head for printing the proof on a printing receiver; the proof being formed with micro-structures of dots that form halftone dots; and c. controllably operating the second named circuitry and print head for making the printing plate, the plate being formed with micro-structures of dots that form halftone dots which are matched to that on the proof so that a print from the plate can be printed that has halftone dot micro-structures substantially identical to that of the proof.

8. The method of claim 7, wherein the first named circuitry and print head is controllably operated at a first drive signal frequency.

9. The method of claim 8, wherein the first named circuitry comprises a clock operable at the first drive signal frequency.

10. The method of claim 7, wherein the second named circuitry and print head is controllably operated at a second drive signal frequency.

11. The method of claim 10, wherein the second named circuitry comprises a clock operable at the second drive signal frequency.

12. The method of claim 7, wherein the first named circuitry and print head is operated for generating said ink drops of the first predetermined volume using a first drive signal wave form and the second named circuitry and print head is operated for generating said ink drops of said second predetermined volume using a second drive signal wave form different from said first drive signal wave form.

13. The method of claim 12 wherein the first drive signal wave form is different from the second drive signal wave form in amplitude.

14. The method of claim 12 wherein the first drive signal wave form is different from the second drive signal wave form in frequency.

15. An ink jet printer adapted for making printing plates and proofs of works to be printed using the printing plates, comprising:

a first element including circuitry operable for generating ink drops of a first controlled volume for making the proofs, each proof having micro-structures of dots that form halftone dots;

a second element including circuitry operable for generating drops of a second controlled volume of a liquid for making t he printing plates, each plate corresponding to a proof having micro-structures of dots that form halftone dots on the plate that are matched to that on the proof so that a print from the plate can be printed that has a halftone dot micro-structure that is substantially identical to that of the proof; and a control element for selectively operating the first element or the second element for generating the drops of a selected controlled volume.

16. The ink jet printer of claim 15, wherein said first element further comprises a print head and a source of ink connected to said print head.

17. The ink jet printer of claim 15, wherein said second element further comprises a print head and a source of said liquid connected to said print head.

18. The ink jet printer of claim 17, wherein said liquid comprises a polymer containing liquid.

19. A method for producing an image formed of printed dots on a final receiver sheet printed using a printing plate, the method comprising:

operating an inkjet printer including a printhead and driver circuitry for operating the printhead to generate ink drops of a first ink drop volume on a proofing receiver to form an image substantially identical to that to be formed on the final receiver sheet;

determining a second ink drop volume for printing dots using inkjet printing on a printing plate based an observation of dot size in the proofing receiver and dot said between dots printed on the printing plate and dots formed on a final receiver sheet that comprises a print to be made using the printing plate;

printing by inkjet printing an image on the printing plate using the second ink drop volume determined, the image on the printing plate having a dot size suited for printing the image to be formed on the final receiver sheet and the second ink drop volume being different than the volume of the first ink drop volume; and printing the image on the final receiver sheet to form the print using the printing plate, the dot size printed on the final receiver sheet being substantially identical to that formed on the proofing receiver.

20. The method according to claim 19 wherein in the step of determining the dot size of dots in the proofing receiver the micro-structures of halftone dots in the proofing receiver are examined.

21. The method according to claim 20 wherein the second ink drop volume is larger than the first ink drop volume.

22. The method according to claim 19 wherein the second ink drop volume is larger than the first ink drop volume.

* * * * *